US009068465B2

(12) United States Patent
Keny et al.

(10) Patent No.: US 9,068,465 B2
(45) Date of Patent: Jun. 30, 2015

(54) TURBINE ASSEMBLY

(75) Inventors: Mayur Abhay Keny, Karnataka (IN); Fernando Jorge Casanova, Simpsonville, SC (US); Prathap Raj Rajendran, Karnataka (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 539 days.

(21) Appl. No.: 13/459,931

(22) Filed: Apr. 30, 2012

(65) Prior Publication Data

US 2013/0287556 A1 Oct. 31, 2013

(51) Int. Cl.
*F01D 5/30* (2006.01)
*F01D 5/32* (2006.01)

(52) U.S. Cl.
CPC ..... *F01D 5/3038* (2013.01); *F01D 5/32* (2013.01)

(58) Field of Classification Search
CPC ..... F01D 5/3023; F01D 5/303; F01D 5/3038
USPC ..... 416/215, 216, 217, 218, 248, 500
See application file for complete search history.

(56) References Cited

U.S. PATENT DOCUMENTS

| | | | | |
|---|---|---|---|---|
| 4,451,203 | A | 5/1984 | Langley | |
| 5,584,658 | A | 12/1996 | Stenneler | |
| 7,419,360 | B2 * | 9/2008 | Chatel et al. | 416/215 |
| 2007/0014667 | A1 | 1/2007 | Pickens et al. | |
| 2009/0208338 | A1 * | 8/2009 | Major et al. | 416/215 |
| 2010/0296936 | A1 * | 11/2010 | Wilson et al. | 416/217 |

* cited by examiner

*Primary Examiner* — Richard Edgar
(74) *Attorney, Agent, or Firm* — Cantor Colburn LLP

(57) ABSTRACT

According to one aspect of the invention, a turbine assembly includes a rotor wheel and a circumferential slot formed in the rotor wheel, the circumferential slot including a uniform cross-section shape for a circumference of the rotor wheel. The assembly also includes a first ring member positioned in the circumferential slot, the first ring member being configured to prevent radial movement of a dovetail attachment when positioned in the circumferential slot, wherein the dovetail attachment is part of a turbine blade.

6 Claims, 4 Drawing Sheets

TURBINE ASSEMBLY

BACKGROUND OF THE INVENTION

The subject matter disclosed herein relates to turbine engines and, more particularly, to rotor assemblies for turbine engines.

Turbine blades or buckets are often designed for installation on a turbine rotor wheel in a circumferential direction. The buckets are typically attached to the turbine wheel using external circumferential dovetails, with a receiving dovetail in a circumferential groove or slot on the wheel periphery and a complimentary dovetail in the base or root of the bucket. In order to load these buckets onto the wheel, a notch which locally removes the receiving dovetail portion is cut on the periphery of the wheel, leaving a generally rectangular opening in the slot on the rotor wheel. Each bucket is then initially placed in the notch opening and then moved circumferentially around the wheel. The opening in the circumferential groove causes a discontinuity in the relatively uniform rotor wheel design. Thus, the notch opening can be a source of stress concentration in the rotor wheel and can lead to reduced rotor life.

BRIEF DESCRIPTION OF THE INVENTION

According to one aspect of the invention, a turbine assembly includes a rotor wheel and a circumferential slot formed in the rotor wheel, the circumferential slot including a uniform cross-section shape for a circumference of the rotor wheel. The assembly also includes a first ring member positioned in the circumferential slot, the first ring member being configured to prevent radial movement of a dovetail attachment when positioned in the circumferential slot, wherein the dovetail attachment is part of a turbine blade.

According to another aspect of the invention, a turbine assembly includes a rotor wheel, a circumferential slot formed in the rotor wheel configured to receive blades, and first and second ring members positioned in the circumferential slot, the first and second ring members located on each side of a portion of a blade to prevent radial movement of the blade when positioned in the circumferential slot.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
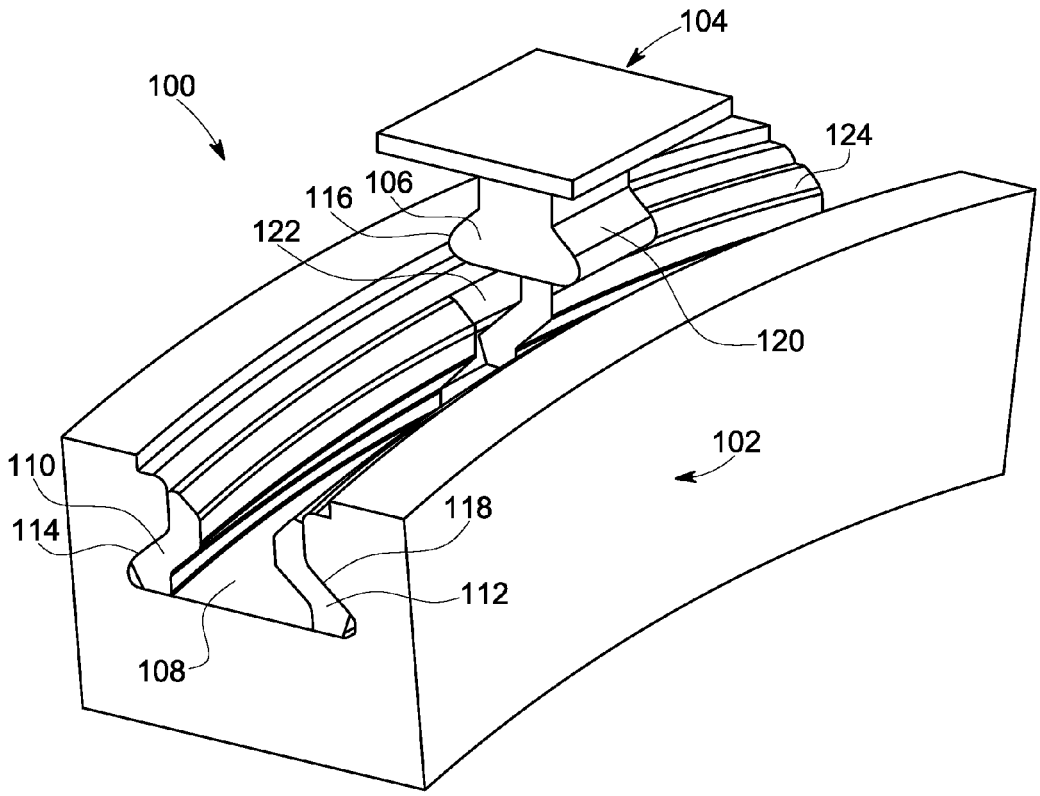
FIG. 1 is a perspective view of a rotor wheel and a turbine blade according to an embodiment.

FIG. 1 is a perspective view of a portion of an exemplary turbine assembly 100 including a rotor wheel 102 configured to receive a blade 104. The blade 104 includes a dovetail pin or attachment 106 that is positioned in a circumferential slot 108 of the rotor wheel 102. In an embodiment, a first ring member 110 and a second ring member 112 are placed in the circumferential slot 108 and are configured to retain the blade 104 and prevent radial movement of the blade 104 when placed in the circumferential slot 108. In one embodiment, the rotor wheel 102 has the first ring member 110 and second ring member 112 in the circumferential slot 108 prior to installation of blades, including the blade 104. The ring members can be inserted radially into the slot and slid axially to mate with the wheel side face forming the circumferential slot 108. When positioned in the circumferential slot 108, the first ring member 110 and second ring member 112 form an opening 122 enables insertion of the blades and corresponding dovetail attachment into the circumferential slot 108. As described below, after insertion into the opening 122, the blade 104 slides circumferentially along the circumferential slot 108 to allow installation of subsequent blades about the wheel's circumference.

In an embodiment, when the blade 104 is installed in the rotor wheel 102, the first ring member 110 is positioned between a first side wall 114 of the circumferential slot 108 and a first side 116 of the dovetail attachment 106. Similarly, the second ring member 112 is positioned between a second side wall 118 of the circumferential slot 108 and a second side 120 of the dovetail attachment 106 when the blade 104 is located in the circumferential slot 108. In an embodiment, the first ring member 110 and second ring member 112 conform to the first side wall 114 and second side wall 118, respectively, of the circumferential slot 108. As depicted, the circumferential slot 108 has a substantially uniform cross section shape for the entire circumference of the rotor wheel 102. The cross section shape of the circumferential slot 108 may be any suitable shape to receive one or more blades and one or more ring members. The depicted embodiment of the circumferential slot 108 has a substantially dovetail shape that is larger than the dovetail attachment 106.

In an embodiment the sidewalls on the dovetail and the rotor wheel 102 may be of different inclination or profile, where the ring member sidewalls having complementary profiles to the mating wheel or dovetail attachment profile.

The substantially uniform cross section shape of the circumferential slot 108 reduces stress concentration points in the relatively uniform wheel that may occur in other rotor wheel embodiments. Specifically, the opening 122 and retaining characteristics provided by the first ring member 110 and second ring member 112 enable blade retention in the substantially uniform circumferential slot 108. In an embodiment, the first ring member 110 and second ring member 112 are not attached, fixed or coupled to the rotor wheel 102. In other embodiments, one or more of the ring members 110, 112 are attached to the rotor wheel. In addition, the first ring member 110 and second ring member 112 may be each comprised of or more ring members that form the rings 110 and 112. In one exemplary embodiment, the first ring member 110 comprises a plurality of member portions, such as member portion 124. Exemplary ring members may be formed from 2, 3, 5, 50 up to any suitable number of ring portions as determined application specific criteria. In another embodiment, each of the ring members 110 and 112 are formed from a single ring member. Further, embodiments of the first ring member 110 and second ring member 112 may be identical in shape or geometry or may be shaped differently to meet desired blade loading patterns depending upon the application. An embodiment reduces stress concentration associated with blade load slots on rotor wheels and facilitates use of alternative lower cost materials, thus reducing costs.

The dovetail circumferential slot 108 is typically termed a "circumferential entry" slot in that the dovetail attachment 106 of the blade 104 is inserted into the slot in a generally circumferential direction. The features described herein are generally applicable to any airfoil and disk interface. The structure depicted in FIG. 1 is merely representative of many different disk and blade designs across different classes of turbines.

As used herein, "downstream" and "upstream" are terms that indicate a direction relative to the flow of working fluid through the turbine. As such, the term "downstream" refers to a direction that generally corresponds to the direction of the flow of working fluid, and the term "upstream" generally refers to the direction that is opposite of the direction of flow of working fluid. The term "radial" refers to movement or position perpendicular to an axis or center line. It may be useful to describe parts that are at differing radial positions with regard to an axis. In this case, if a first component resides closer to the axis than a second component, it may be stated herein that the first component is "radially inward" of the second component. If, on the other hand, the first component resides further from the axis than the second component, it can be stated herein that the first component is "radially outward" or "outboard" of the second component. The term "axial" refers to movement or position parallel to an axis. Finally, the term "circumferential" refers to movement or position around an axis. Although the following discussion primarily focuses on gas turbines, the concepts discussed are not limited to gas turbines and may apply to any suitable machinery, including steam turbines, oil and gas machinery and aviation engines. Accordingly, the discussion herein is directed to gas turbine embodiments, but may apply to other turbine systems.

Figure 2:
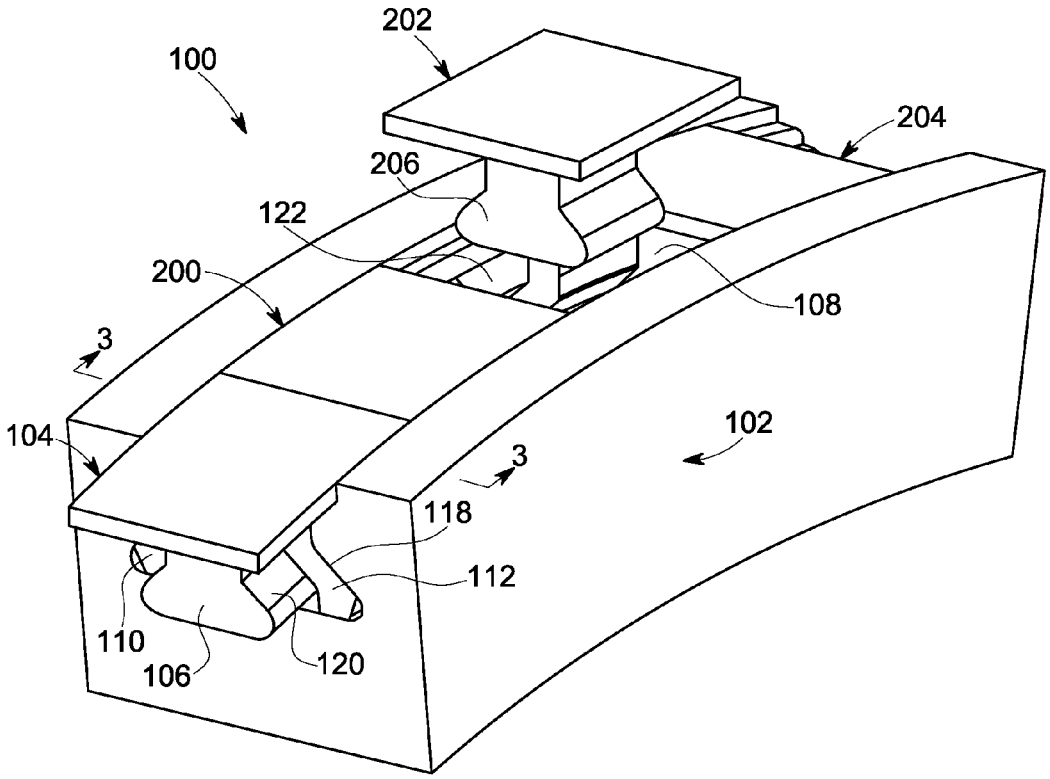
FIG. 2 is a perspective view of turbine blades and the rotor wheel shown in FIG. 1.

FIG. 2 is a perspective view of the turbine assembly 100 from FIG. 1 with a plurality of blades installed. The depicted embodiment shows a portion of the rotor wheel 102 and circumferential slot 108 receiving the blade 104 followed by a second blade 200, a third blade 202 and a fourth blade 204. In an exemplary assembly process, the first ring member 110 and second ring member 112 are positioned and are axially spaced apart within the circumferential slot 108 to receive blades. Accordingly, in the next assembly step, the first blade 104 is inserted in the opening 122 and slid circumferentially along the circumferential slot 108 to enable insertion of the second blade 200 in the opening 122. After the second blade 200 is inserted in the circumferential slot 108 it is also slid circumferentially, thus pushing the first blade 104 circumferentially, to enable placement of the third blade 202 and its dovetail attachment 206 in the opening 122. In an embodiment, substantially similar steps are repeated to place blades about the entire circumference of the rotor wheel 102.

Figure 3:
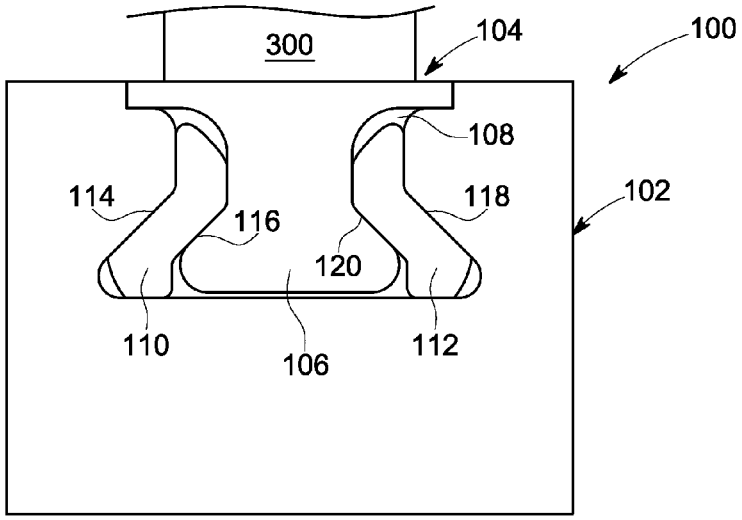
FIG. 3 is a detailed sectional view of the turbine blades and rotor wheel shown in FIGS. 1 and 2.
Figure 5:
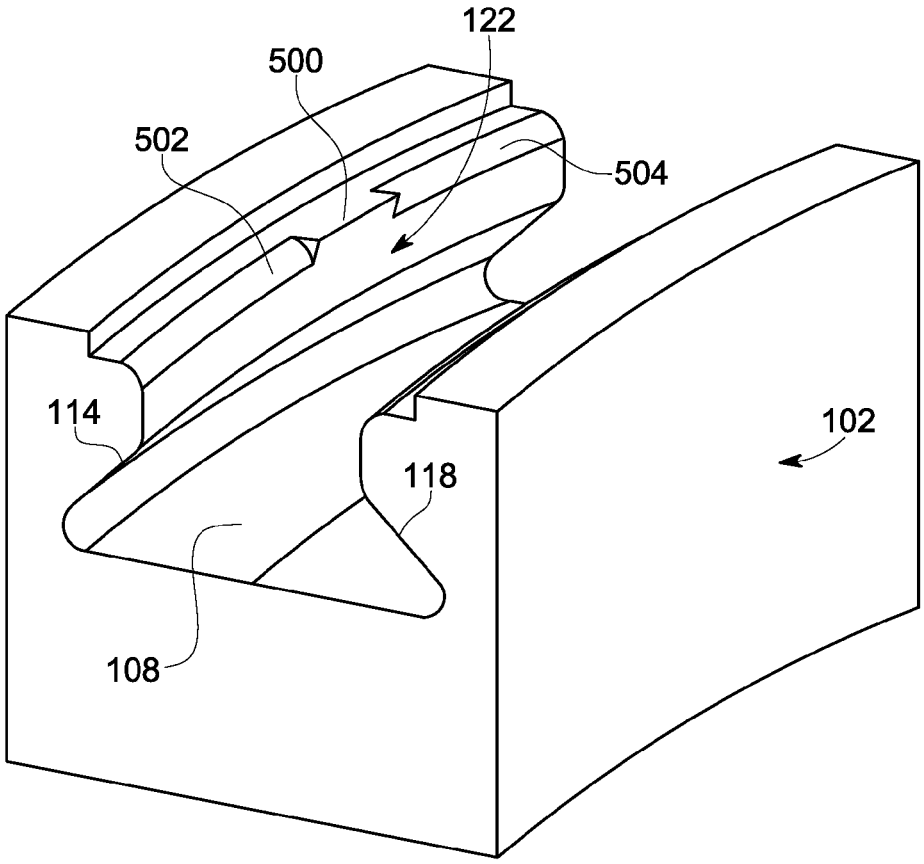
FIG. 5 is a detailed perspective view of a portion the turbine assembly shown in FIG. 1.

FIG. 3 is a sectional view of the turbine assembly 100 shown in FIGS. 1 and 2. An embodiment includes the first ring member 110 and second ring member 112 axially spaced apart to receive and secure the dovetail attachment 106. As depicted, the blade 104 includes an airfoil 300 that extends from the dovetail attachment 206 into a hot gas path of the turbine. In embodiments, the first ring member 110, second ring member 112 and blade 104 are not attached or coupled to each other via any fasteners, adhesives or other mechanisms. However during machine operation the blades dovetail, ring and wheels will form tight contact due to centrifugal forces. As shown in FIG. 5, a feature, such as a protrusion 500, may be formed in each side of the circumferential slot 108. The protrusion 500 prevents circumferential movement of the first ring member 110 and second ring member 112 and enables blades to be received within opening 122. The depicted arrangement simplifies manufacturing, as the ring members 110, 112 enable more flexibility for manufacturing tolerances of the circumferential slot 108. Specifically, the ring members 110, 112 are machined to receive the blade 104 while the circumferential slot 108 may be manufactured by a less precise and thus less expensive process, such as casting or rolling. In addition, the circumferential slot 108 and ring members 110, 112 may be any suitable geometry to retain blades within the slots.

Figure 4:
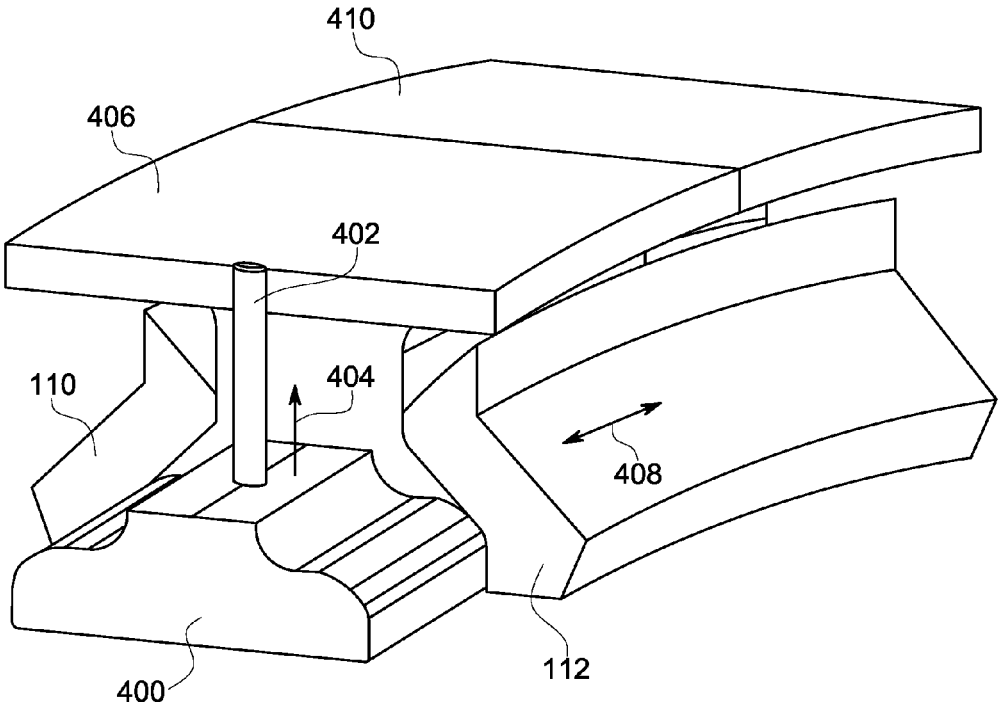
FIG. 4 is a perspective view of a turbine assembly that includes a locking member configured to prevent movement of blades and ring members in a rotor wheel according to an embodiment.

Referring now to FIG. 4, a turbine assembly is shown that includes a locking member 400 to be placed in the circumferential slot 108 of the rotor wheel 102. In an embodiment, the locking member 400 is configured to be placed in the circumferential slot 108 before a closure blade is placed in the circumferential slot 108. After insertion of the closure blade the blade assembly may be moved circumferentially to locate the locking member 400 in the opening 122 between the set of ring members. The locking member 400 is so shaped that when moved radially it no longer slides in the gap 108 (between the rings when the dovetail attachment is placed). Thus, the locking member 400 and a screw 402 locking the blades and prevent ring members from moving circumferentially. In one embodiment, the screw 402 is disposed in the locking member 400 and is configured to rotate in place to radially extend in a direction 404 to lock a position of the closure blade and ring members 110, 112 relative to the circumferential slot 108. The screw 402 and locking member 400 may each be threaded to cause the radial movement of the locking member. A closure blade is the last blade placed about the rotor wheel 104 circumference during completion of the assembly process. In the depicted embodiment, a blade 406 is the closure blade positioned between a blade 410 and the locking member 400. The blades 406 and 410 are retained in the circumferential slot 108 by the first ring member 110 and second ring member 112 and are prevented from movement in a circumferential direction 408 by the locking member 400.

FIG. 5 is a detailed perspective view of a portion of the turbine assembly 100 shown in FIG. 1. The embodiment shows the circumferential slot 108 formed in the rotor wheel 102. The circumferential slot 108 includes protrusions 500 on each side of the slot, where the protrusions 500 (only one of which is visible) are configured to prevent movement of the first ring member 110 and second ring member 112 after they are positioned in the slot. The protrusions 500 is positioned proximate the opening 122 between smooth corner portions 502 and 504 which are configured to receive the ring members. In embodiments, any suitable features, such as protrusions, slots and ridges, may be used to position and prevent movement of the ring members relative to the circumferential slot.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine assembly comprising:

a rotor wheel;

a circumferential slot formed in the rotor wheel, the circumferential slot comprising a uniform cross-section shape for a circumference of the rotor wheel;

a first plurality of ring members positioned in the circumferential slot, the first plurality of ring members being configured to prevent radial movement of a dovetail attachment when positioned in the circumferential slot, wherein the dovetail attachment is part of a turbine blade, the first plurality of ring members defining at least one opening between the first plurality of ring members, the at least one opening configured to receive the dovetail attachment in a radial direction before circumferential sliding of the dovetail attachment to fix the position of the dovetail attachment in the circumferential slot;

a second plurality of ring members positioned in the circumferential slot, the second plurality of ring members configured to prevent radial movement of the dovetail attachment when positioned in the circumferential slot, the second plurality of ring members defining at least one opening between the second plurality of ring members, the at least one opening configured to receive the dovetail attachment in the radial direction before circumferential sliding of the dovetail attachment to fix the position of the dovetail attachment in the circumferential slot; and a locking member configured to be placed in the circumferential slot before a closure blade is placed in the circumferential slot, wherein the locking member is configured to radially extend via a screw to lock a position of the closure blade and at least one of the plurality of first ring members relative to the circumferential slot.

2. The turbine assembly of claim 1, wherein the first plurality of ring members is positioned between a first side wall of the circumferential slot and a first side of the dovetail attachment.

3. The turbine assembly of claim 2, wherein the first plurality of ring members conforms to the first side wall of the circumferential slot.

4. The turbine assembly of claim 2, wherein the second plurality of ring members is positioned between a second side wall of the circumferential slot and a second side of the dovetail attachment.

5. The turbine assembly of claim 4, wherein the plurality of second ring members is substantially identical to the plurality of first ring members.

6. The turbine assembly of claim 1, wherein the cross-section shape of the circumferential slot comprises a dovetail shape.

* * * * *